United States Patent [19]

Brisebarre

[11] Patent Number: 4,677,811

[45] Date of Patent: Jul. 7, 1987

[54] METHOD OF AND INSTALLATION FOR PUTTING STACKS OF COINS INTO CARTRIDGES

[75] Inventor: Marcel Brisebarre, Saint Genis Pouilly, France

[73] Assignee: Monec S.A., France

[21] Appl. No.: 856,044

[22] Filed: Apr. 24, 1986

[51] Int. Cl.[4] ..... B65B 11/04

[52] U.S. Cl. ..... 53/456; 53/465; 53/578; 53/212; 53/216; 53/380

[58] Field of Search ..... 53/465, 212, 216, 578, 53/456, 380

[56] References Cited

U.S. PATENT DOCUMENTS

| | | | |
|---|---|---|---|
| 1,171,411 | 2/1916 | Burdick | 53/212 X |
| 1,185,495 | 5/1916 | Gebhardt | 53/216 X |
| 2,699,098 | 1/1955 | Lyons | 53/216 X |
| 2,857,722 | 10/1958 | Smith | 53/216 X |
| 2,952,105 | 9/1980 | Schur | 53/216 X |

*Primary Examiner*—John Sipos

*Attorney, Agent, or Firm*—Wolf, Greenfield & Sacks

[57] ABSTRACT

(a) Method of putting stacks of coins into cartridges, (b) Method characterized in that a sheet of paper (9) is rolled up partially to form at least one circumference of a tube, the stack of coins is placed within this tube and the stack of coins and the tube are displaced towards one of the ends of a track (4) bounded by two surfaces having parallel generatrices of which one (1) is adapted for movement in the direction of movement of the stack and of the tube, this direction being such that it displaces the tube along this track by rolling on the non-moving surface (2).

24 Claims, 19 Drawing Figures

FIG. 7
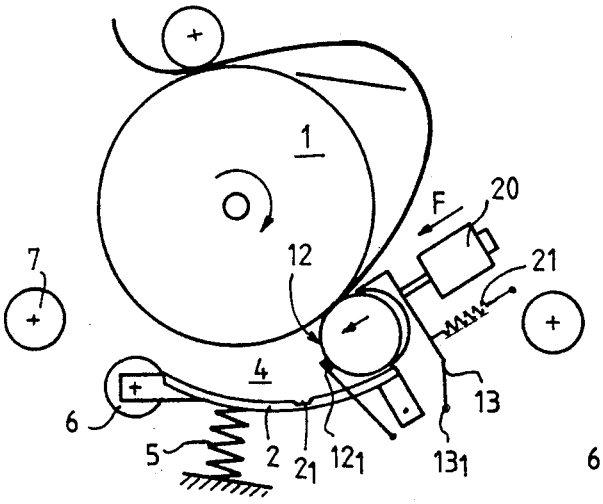
FIG. 8
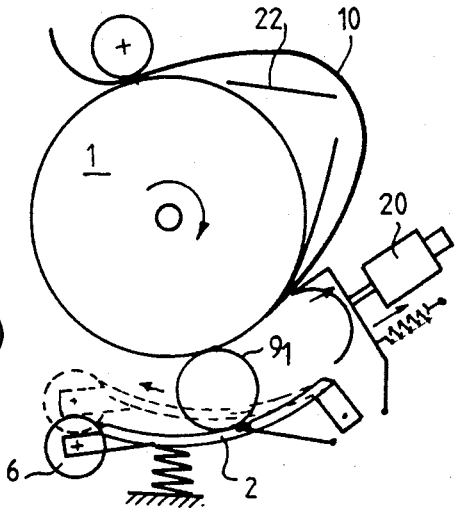
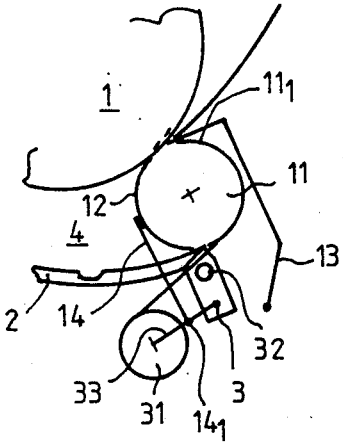
FIG. 9

FIG. 10
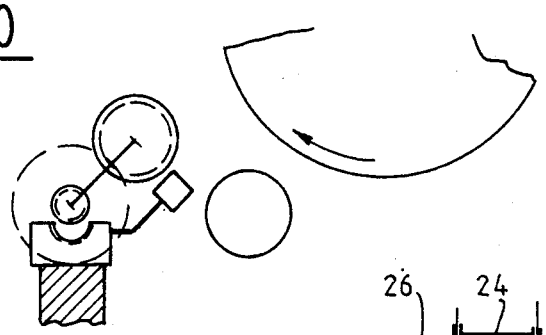
FIG. 11
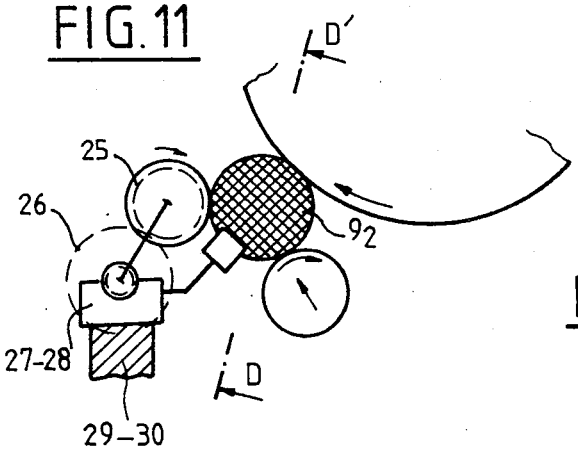
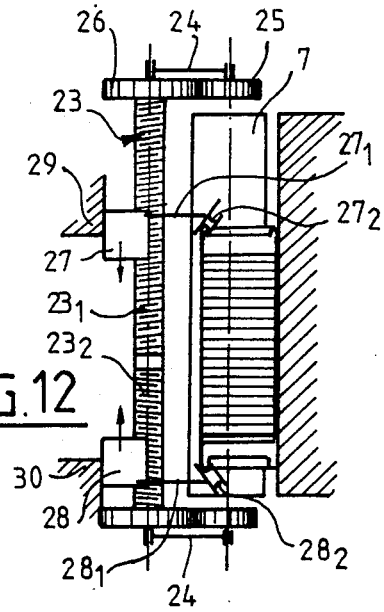
FIG. 12
FIG. 13
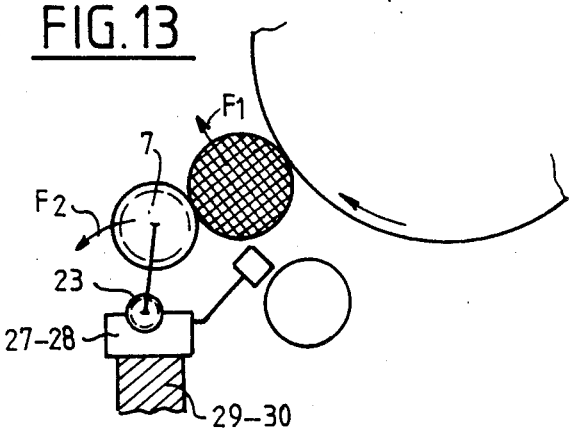
FIG. 14
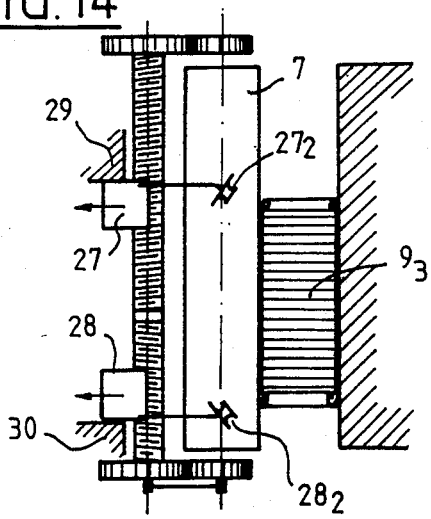

FIG. 17
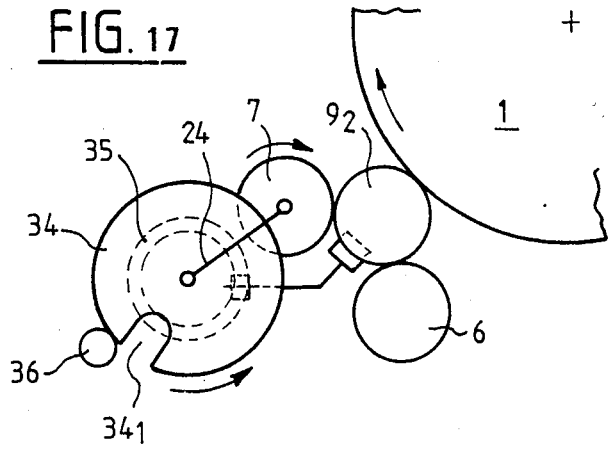
FIG. 18
FIG. 19
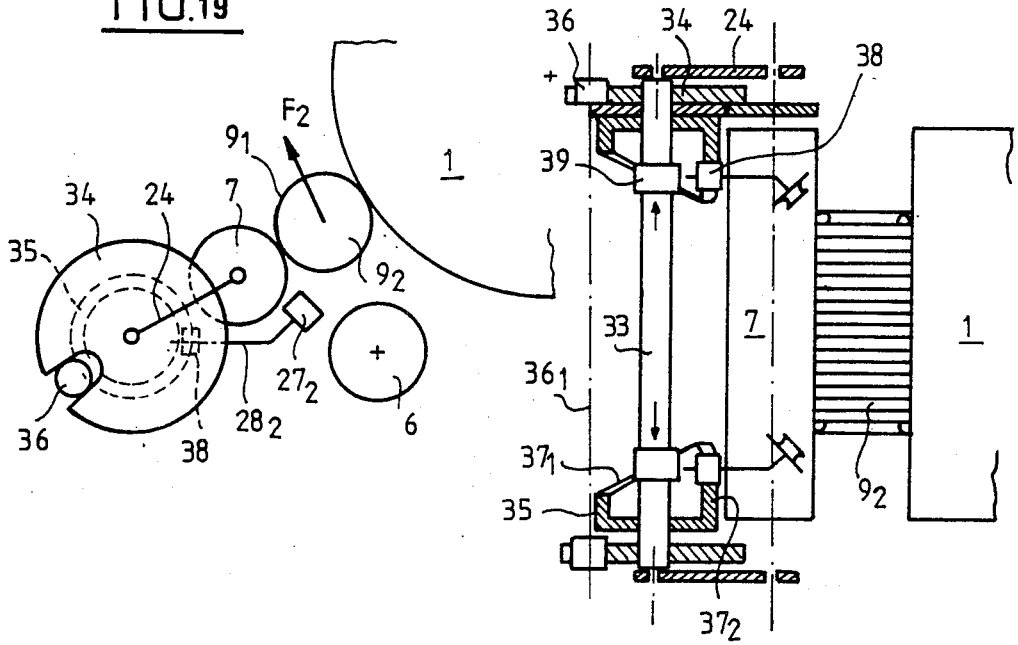

METHOD OF AND INSTALLATION FOR PUTTING STACKS OF COINS INTO CARTRIDGES

The invention relates to a method of and an apparatus for putting stacks of coins into cartridges.

More particularly, this method and this apparatus relate to the putting into cartridges of stacks of coins in tubes made by means of a rolled up paper sheet, the ends of which are folded back and crimped to form beads imparting satisfactory cohesion to the cartridge of coins thus formed.

Plants of this type currently in existence constitute bulky machines by virtue of their size, their complexity and their price and these drawbacks arise from the fact that these machines perform rapid intermittent movements of quite considerable amplitude and involving a large number of mechanical parts. Likewise, these drawbacks arise from the fact that the stack of coins and the sheet of paper are guided, transferred and maintained by independent mechanisms while the most critical problem relates to the transfer of the stack of coins to the crimping device because for this transfer it is necessary rapidly to displace the stack of coins over quite a considerable distance, although their cohesion is still not guaranteed.

Another disadvantage of these known machines resides in the fact that generally the sheet of paper is conveyed to its place around the already formed stack of coins, gripping of the roll of paper around this stack only being possible by means of very accurate guides which are all the more difficult to arrive at since they have to match a diameter which varies according to the face value of the coins.

Finally, control of the crimping elements is performed by arms which are subject to complex and intermittment movements in order to crimp the ends of the cartridge on the stack of coins and then release the formed cartridge and allow the stack of coins corresponding to the next cartridge to be placed in position.

These various intermittent movements of quite considerable amplitude and entailing relatively considerable forces are controlled individually, one in relation to the others, by clutches, cams, linkages, levers, return gears and joints which are the main cause of the complexity and physical heaviness of these machines. This discontinuity of the movements and their considerable amplitude are likewise the more disturbing the faster it is desired to operate.

It is a particular object of the present invention to remedy these drawbacks and to this end it relates to a method of putting stacks of coins into cartridges, characterized in that a sheet of paper is partially rolled up to form at least one complete circumference of a tube of which the circular cross-section is slightly greater than the diameter of the coins to be put into the cartridge form, the stack of coins is placed inside this tube and the stack of coins and the tube are displaced towards one of the ends of a track defined by two surfaces having parallel generatrices of which one is adapted for movement in the direction of displacement of the stack of coins and of the tube, this direction being such that it displaces the tube and the stack of coins along this track by rolling on the non-moving surface, all while continuing the rolling of the sheet of paper around the stack of coins.

According to another characteristic feature of the invention, a mechanism is provided for crimping the ends of the tube of paper on the stack of coins at the end opposite the track, this mechanism acting while the tube of coins is held immobile in position but movable in rotation on itself by maintenance of its contact with the moving surface.

According to another characteristic feature of the invention, the movable surface of the track consists of the periphery of a drum driven to perform a continuous rotary movement and opposite which there is a surface parallel with the axis of this drum, the said surfaces defining between them the track along which the tube of coins rolls, guides of generally circular form being disposed upstream of this track—taking into account the direction of rotation of the drum—these guides being made so as to form, by rolling, at least the complete circumference of the paper tube.

According to another characteristic feature of the invention, the surface disposed opposite the drum for defining the track is mounted to be movable in the direction of the periphery of the drum under the action of elastic means.

According to another characteristic feature of the method of the invention, the method is characterized in that the crimping mechanism is driven by the second roller and through the intermediary of two bell cams which face each other on an axis parallel with the second roller.

The invention is illustrated by way of non-limitative examples in the appended drawings, in which:

FIGS. 7 and 8 represent two further stages of the cycle followed to form the roll of paper around the stack of coins;

FIG. 9 is a diagrammatic elevation of an embodiment showing the adjustment of the machine according to the face value of the coins in the stack;

FIG. 10 is a diagrammatic plan view showing the rest position of an embodiment of device for crimping the ends of the paper tube over the stack of coins;

FIG. 11 is a view corresponding to FIG. 10, the crimping device being shown in operation;

FIG. 12 is a sectional view taken on the line D—D in FIG. 10;

FIGS. 13 and 14 are views corresponding respectively to FIGS. 11 and 12, the crimped stack of coins being in the ejection position;

FIG. 17 is a plan view of FIG. 16;

FIG. 18 shows the crimping mechanism in FIG. 16 upon completion of the crimping operations at the time of ejecting the made up roll of coins, and FIG. 19 is a plan view of FIG. 14.

Consequently, the present invention relates to the provision of a cartridge packaging machine for rolling and crimping a sheet of paper around a stack of coins, the said mechanism being of extremely simple and therefore inexpensive and lightweight construction.

According to the invention, it is thus envisaged only to use the motor movement in a continuous manner and particularly in the form of rotary movements while the intermittent movements which are still necessary are only of minor amplitude and are then obtained independently of the motor by actuating means such as electromagnets which act directly on the controlled member, that is to say without clutch and without transmission.

Furthermore, according to the embodiment described, the cartridge being formed itself constitutes one of the elements useful in the kinematic chain by doing away with or minimizing the part played by other mechanical elements and furthermore causing the triggering of successive operations by its own progression. Such principles can be effectively applied while resorting to two factors which depend one upon the other, in other words the stacking of the coins in a partially mae tube of paper and constituted by at least one circumference of this paper, and then entraining and rolling this assembly by gripping it between a movable surface and a fixed surface.

Figure 1:
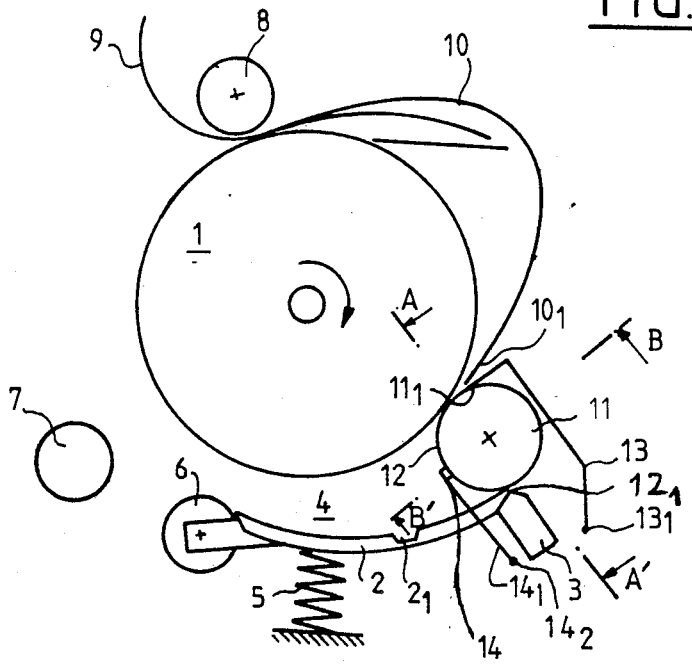
FIG. 1 is an elevation of one embodiment of the invention.
Figure 2:
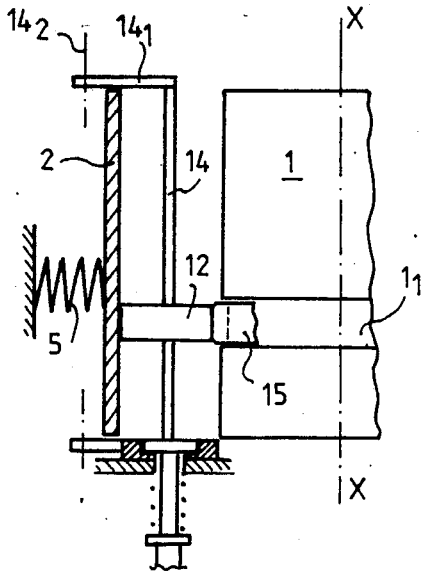
FIG. 2 is a section taken on the line A—A in FIG. 1.

Thus, according to FIG. 1, the continuous motor movement is obtained by the drum 1 of which the periphery is preferably lined with an elastically compressible material. Opposite the periphery of this drum there is a rigid and curved surface 2 of which the generatrices are parallel with the axis X—X, this surface too being mounted to pivot according to an axis 3 parallel with the axis X—X and determining with the periphery of the drum 1 a corridor 4 which, as will be seen later, constitutes the track for rolling of the cartridge during formation.

A spring 5 constantly seeks to push the surface 2 towards the periphery of the drum 1 while at the free end of this surface 2 there is a freely rotatably mounted roller 6. In proximity of this roller 6 there is a second roller 7 which is likewise mounted to rotate freely and which comes into operation during the crimping of the ends of the cartridge, as will be seen hereinafter.

Provided close to the periphery of the drum 1 is a roller 8 adapted for movement parallel with its axis under the action of an operating means in order to press the sheet of paper 9 against the motor drum 1. In this case, rotation of the drum 1 pushes the sheet of paper against the concave surface of the curved guide 10 so that the end of this sheet of paper is, at the end $10_1$ of this guide, brought into proximity of the periphery of the drum 1 and of two guides 11 and 12 together defining a circular cross-section of which the diameter is slightly greater than the diameter of the face value of the coins in the stack to be cartridge packaged. The guide 11 consists preferably of a sheet of lexible material of the foil type and is fixed at its end $11_1$ to a linkage 13 pivoting at $13_1$ according to an axis parallel with the axis X—X.

Similarly, the guide 12 is constituted by a thin and elastically deformable blade fixed at $12_1$ at the upstream end of the surface 2 and bearing on the rod 14 which defines the curvature of the blade.

At rest, this guide 12 disposed across the corridor 4 is thus made in such a way that it can move aside from this corridor and be applied against the surface 2 when it is pushed back by a tube of coins. In this case, the rod 14 becomes housed in a notch $2_1$ in the surface 2.

It will be noted however that instead of providing a notch $2_1$ to receive the rod 14, it is possible to make the surface 2 in such a way that its inner face is flexible and elastically deformable while the rod 14 is made sufficiently slender that it can fit into this flexible face when the guide 12 moves aside.

According to another form of embodiment, the movable surface 1 defining one of the sides of the guide track may be made in various ways and for example by means of several belts kept tensioned parallel on at least two drums having axea parallel with the axis of the drum 1, which would have the advantage of rendering the surface 2 flat.

The periphery of the drum 1 is provided with an annular groove $1_1$ inside which is partially housed a guide surface 15 inclined in relation to the periphery of the drum 1 and 6f which the end outside this drum is placed at the height of the guide 12 in order to ensure guidance of the paper emanating from the curved guide 10 towards the guide 12 and then towards the guide 11.

Figure 4:
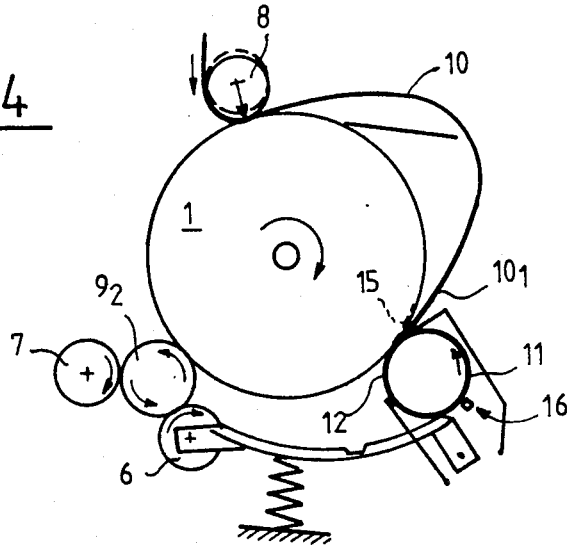
FIG. 4 is a view corresponding to FIG. 1 shown in the stage of formation of a circumference of the paper tube.
Figure 5:
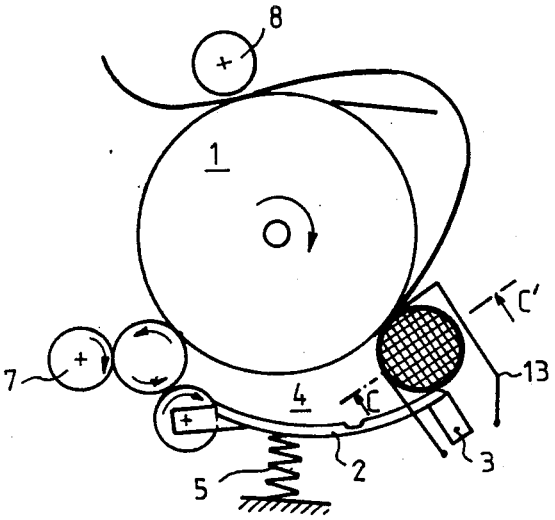
FIG. 5 is a view corresponding to FIG. 1 showing the stage where the stack of coins is deposited in the formed tube.

Thus (see FIG. 4) when the roller 6 applies the sheet of paper against the drum 1, the sheet 9 follows the concave curvature of the curved guide 10 then, when it arrives close to the end $10_1$ of this guide, it is diverted by the inclined guide 15 so that it follows the circular guides 12 and 11 and forms a tube of paper of circular cross-section.

Close to these guides 11 and 12 there is a detector 16 which notes the passage of the end of the sheet of paper and which, through the intermediary of a timing device, restores the roller 6 to its initial position at the moment when the free end of this sheet of paper forms one complete circumference.

When this partial winding of the sheet of paper is carried out to constitute a tubular structure, the stack of coins is then placed in the tube $9_1$ which is thus formed.

Figure 6:
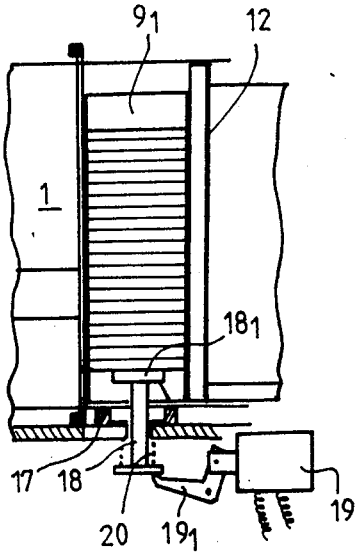
FIG. 6 is a section taken on the line C—C' in FIG. 5.

To this end, the machine comprises under the circular guides 11 and 12 a bearing surface 17 into which is inserted the head $18_1$ of a push member 18. The head $18_1$ may be moved into a high position above the bearing surface 17 (see FIG. 6) under the action of an electromagent 19 and through a bent lever $19_1$. On the other hand, return of the head $18_1$ to its initial position in the plane of the bearing surface 17 is carried out under the action of a return spring 20 (see FIG. 3).

Prior to the depositing of the stack of coins in place, the head $18_1$ is situated in the plane of the bearing surface 17. The coin distributor (for example, a coin counter) then allows a few coins (for example, three or four) to fall into the paper tube $9_1$ so that they become stacked on the bearing surface 17. At this moment, the electromagnet 19 is operated in order to place the head $18_1$ in a high position, after which the coin distributor allows the number of coins envisaged to constitute the stack which has to be cartridge packaged to fall into the tube $9_1$.

This embodiment and this mode of operation offer numerous advantages.

In view of the fact that the first coins in the stack fall onto the flat bearing surface 17, they assume a stable position and are in no danger of toppling, which might be likely to occur particularly in the case of large diameter coins, if they were to fall on the head $18_1$ placed in the high position, this head $18_1$ being necessarily of a relatively small diameter since it must be smaller than the smallest diameter of the coins which are to be cartridge packaged.

When the push member 18 is actuated by the electromagnet 19, the head $18_1$ raises the few stacked coins without allowing them to tip, this commencement of a stack then making sure that the other coins which fall into the tube $9_1$ become regularly stacked upon one another.

The raising of the head $18_1$ has the effect of positioning the bottom end of the stack of coins in relation to the bottom end of the tube $9_1$ so that this end of the tube of paper passes sufficiently beyond the base of the stack of coins for it then to be crimped by the crimping mechanisms.

It will however be noted that this raising of the head $18_1$ while it is only supporting a few coins makes it possible to move these few coins vertically inside the tube $9_1$ with no risk of at the same time raising the tube which would otherwise occur, taking into account the friction created if the head $18_1$ were to raise the whole of the stack of coins in the tube.

Likewise, this raising of the head $18_1$ while it is only supporting a few coins makes it possible to use a low power electromagnet member 19 with a short response time, which would not be the case if its operation were to lift the entire stack of coins.

At this stage, the stack of coins containing the desired nubmer of coins is disposed in a midway position in the tube $9_1$ which is constituted solely by one circumference of paper maintained in its circular form by guides 11 and 12.

The following stage must consist of finishing the making of the tube by gripping the paper on the stack of coins, these operations being carried out likewise from the same motor drum (see FIGS. 7 and 8).

To this end, the linkage 13 pivoting at $13_1$ and engaged at $11_1$ on the semi-circular guide 11 is linked to the end of the operating rod of an electromagnetic member 20 so that the actuation of this member 20 causes the linkage 12 to pivot, pushing back the tube $9_1$ containing the coins in the direction of the arrow F, that is to say in the corridor 4 which then constitutes a guide track to complete the rolling of the sheet of paper around the tube 9 and to convey this tube containing the stack of coins directly into the crimping mechanism.

When the electromagnet member 20 is actuated, it causes displacement of the tube 9 and the stack of coins in the direction of the arrow F, at a right-angle to the axis of the stack, at a speed such that the speed of the generatrix of the stack which comes in contact with the drum 1 is greater than the peripheral sped of the drum 1 so as to avoid unwinding of the paper of the tube $9_1$ when this tube is gripped in the upstream end of the corridor 4 between the surface 2 and the drum 1.

Simultaneously with this displacement, the surface 17 is caused to move laterally over a short fraction of the path which releases the rod 18 from the elbow lever $19_1$. The head $18_1$ of the rod 18 then returns abruptly to the low position under the action of the spring 20 so as not to impede progress of the roll of coins along the track 4.

When the electromagnet 20 has pushed the tube of coins between the drum 1 and the surface 2, the spring 21 restores the linkage 13 to its initial position, which involves no risk of destroying the tubular structure $9_1$ in view of the fact that the free end of the sheet of paper is in this case gripped between the drum 1 and the surface 2 through the stack of coins, the coins in the stack being themselves maintained against one another by reason of this gripping action. As soon as the tube of coins is thus pushed, it is caused to rotate by rolling on the curved surface 2 by reason of its entrainment by the drum 1. Rolling of the tube on the surface 2 has the effect of folding back flat the guide 12 of which the supporting linkage 14 becomes housed in the notch $2_1$ in the surface 2. When this movement takes place, the guide 12 becomes progressively adapted along the surface 2, in view of its flexibility and thinness, which makes this guide capable of moving aside so that rolling of the tube $9_1$ containing the stack of coins can continue along the path formed by the corridor 4 (see FIG. 8).

During this rolling of the tube, the loop of paper formed initially against the concave guide 10 becomes resorbed, so that it comes in contact with a cutting blade 22 disposed between the drum 1 and the concave guide 10. To cut the sheet of paper to the desired length according to the diameter of the coins, it is envisaged to maintain the supply roll 8 applied against the drum 1 for a period of time which may vary in order to be able to vary the moment when the paper is held taut and applied against the edge of the cutter 22.

When the tube $9_1$ arrives at the downstream end of the track 4, it passes suddenly over the roller 6 and becomes seated between this roller 6, the roller 7 and the drum 1 which continues to impart a rotating movement to the tube of paper containing the coins so as to carry out the operation of crimping the ends of the tube on the ends of the stack of coins.

It will be noted that as soon as a tube of coins $9_2$ is situated in the crimping position between the rollera 6 and 7 and the drum 1 (see FIG. 1), it is possible to undertake the making of a new tube $9_1$ by bringing the roller 8 in contact with the periphery of the drum 1.

The crimping dvice comprises a screwthreaded rod 23 which has two zones of opposite pitch 23 and $23_2$. This rod is positioned in relation to the roller 7 by spacers 24 which are kept at a constant distance apart.

The screwthreaded rod 23 is caused to rotate by a drum 1 through the medium of the tube of coins $9_2$, the roller 7 and pinions 25 and 26 which mesh with each other and of which one is rigid with the roller 7, the other with the threaded rod 23. Facing the threaded rod 23 are two half-nuts 27 and 28, each of which supports, on arms $27_1$ and $28_1$, inclined rollers $27_2$ and $28_2$ of which the profile is such that they are capable of folding back inwardly the ends of the paper tube to carry out the crimping operation. The whole installation comprising the cylinder 7, the screw 23, the connecting means 24, 25, 26 as well as the half nut of the lead screw 27, 28 and the lock beading parts $27_2$, $28_2$ is mobile between a position at a distance from the drum (FIG. 10) and a position near the drum (FIGS. 11 and 12).

The half-nuts 27 and 28 are, at rest, spaced apart from the screwthreaded rod 23 (FIG. 10). During the crimping operation (FIGS. 11 and 12), they are pushed against this screwthreaded rod by abutments 29 and 30 so that rotation of the screwthreaded rod 23 causes their movement towards each other and therefore a movement towards each other of the inclined rollers $27_2$ and $28_2$ which then perform the crimping. In the position of FIGS. 11 and 12, the limit stops 29, 30 press against the half nut of the lead screw 27, 28 and keep the whole installation near the drum 1.

The spacing apart of these abutments 29 and 30 is regulable and is determined according to the height of the cartridge to be made. When the crimping of the cartridge is finished, the half-nuts 27 and 28 escape from the abutments 29 and 30 (see FIG. 14) causing displacement of the assembly consisting of the rod 23, the roller 7, the spacers 24, the pinions 24–25 and the half-nuts 27, 28. The rotation of the drum 1 makes the screw 23 rotate with the help of the battery of parts $9_3$ of the roller 7 and the cogged wheels 25, 26. The rotation of the screw 23 approaches the half nuts of the lead screws 27, 28 which carry out the lock beading of the tube for coins. At the end of the lock beading, one of the half nuts 27 is right below the stop 29. The other half nut 28 is right above the stop 30 so that these half nuts are no longer held but are at a distance from the screw 23. The whole installation 7, 23, 25, 26 can move, which immediately happens if the rotation of the roller 7 is reduced. In this position, the roller 7 is farther removed from the drum 1 (see FIG. 13) and rotation of the drum 1 together with braking of the drum 1, so causing conversion of the rotary movement upon itself of the cartridge $9_3$ into a rolling movement of this cartridge on the roller 7. The roller 7 becomes a "fixed" surface in rotation and the cylinder of coins 9 brought into rotation by the drum 1 rolls on the fixed roller 7. This movement causes ejection of the cartridge in the direction of the arrow F1 (FIGS. 13 and 14) while the roller 7 pivots in the direction of the arrow F2 against its return spring. In practice it is not indispendable to "stop" this rotating roller 7. It is enough to reduce the speed sufficiently in order to obtain a sufficient reaction to the tangential effort the tube carries out on the roller due to the fact that the tube is brought into rotation.

When the cartridge is ejected, return springs restore the assembly comprising the rod 23 and the roller 7 to the initial inoperative position (FIG. 10), the effect of which is to move sufficiently apart the half-nuts 27, 28 from the rod 23 for elastic restoring means to act laterally and axially, returning these half-nuts to their initial position.

Functioning of the machine according to the invention is of course adapted to the making-up of cartridges of stacks of coins of various face values and it therefore comprises means for adjusting the diameter of the tube $9_1$.

To this end (see FIG. 9), the flexible guide 11 which has one of its ends $11_1$ attached to the linkage 13 consists of a blade, the other end of which is wound onto a roller 31 of which the angle of rotation changes according to the size of the loop forming the guide 11. Guide means such as rollers 32 are provided so that this guide 11 maintains its approximately semi-circular form whatever the diameter of the cartridge made.

These guide means 32 are provided on the support of the fixed surface 2, the pivoting axis 33 of which is movable in relation to the periphery of the drum 1 likewise according to the face value of the coins to be cartridge packaged in order to modify the width of the corridor 4.

Finally, the guide 12 occupies a position of rest which is adjustable according to the face value of the coins in the stack and to this end the pivoting axis $14_1$ of its linkage 14 is disposed on a support 33 which is common for the axis of the roller 31 and the axis 3 around which the surface 2 is adapted to pivot.

FIGS. 16 to 19 illustrate an embodiment of a mechanism which automatically triggers the operation of crimping, performance of the crimping by rolling of the two ends of the paper tube formed on the stack of coins and then ejection of the crimped cartridge.

Figure 15:
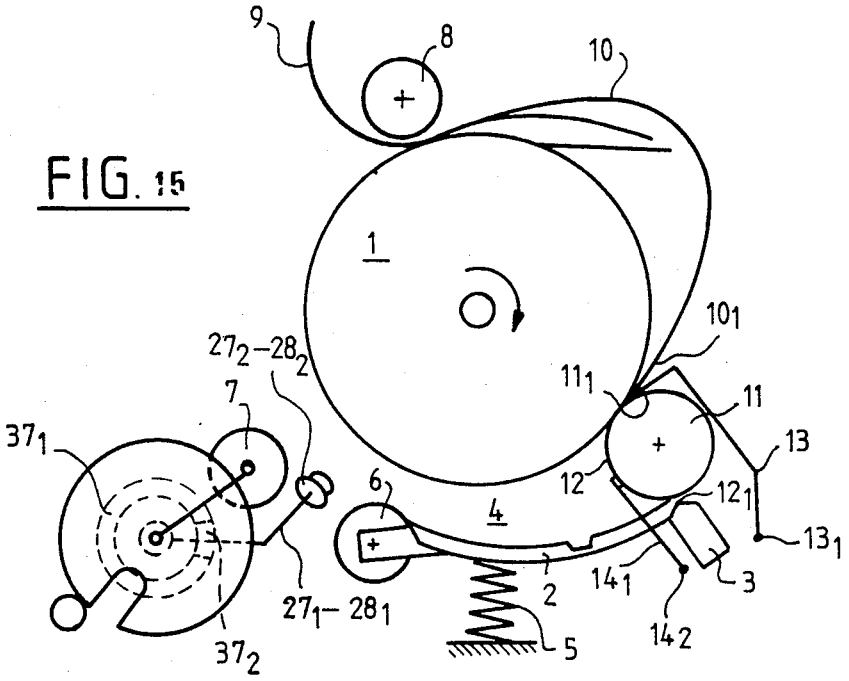
FIG. 15 is a diagrammatic plan view of another embodiment of the installation according to the invention.
Figure 16:
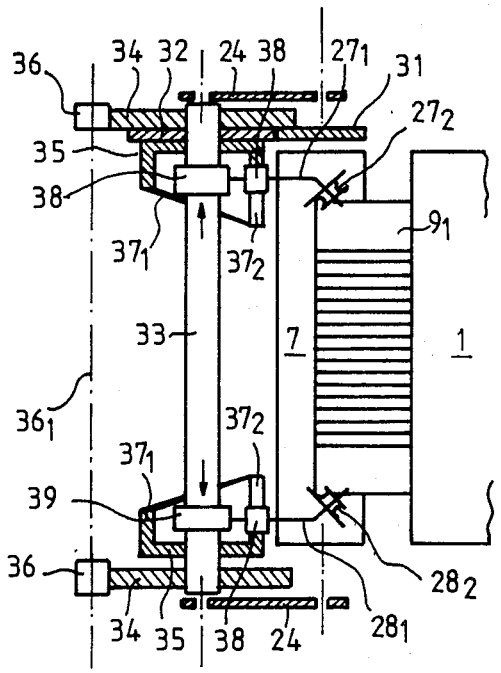
FIG. 16 is a side view of the crimping mechanism at the start of a crimping operation.

The installation shown in FIG. 15 comprises a movable driving surface consisting of a drum 1 opposite which there is a rigid curved surface 2 pivoting about an axis 3 parallel with the axis of the drum. The drum and the surface 2 define between then a corridor 4 constituting the rolling track of the cartridge which is being formed.

A spring 5 constantly seeks to push the surface 2 twoards the periphery of the drum 1 while at the free end of this surface 2 there is a roller 6 which is mounted to rotate freely. Close to this roller 6 there is a second roller 7 which is likewise mounted to rotate freely and through the intermediary of which the crimping mechanism is entrained, the said mechanism consisting of two arms $27_1$, $28_1$ supporting the crimping rollers $27_2$, $28_2$. These rollers are applied onto the ends of the rolled up sheet of paper to roll this sheet on itself and form crimped beads at the ends of the stack of coins.

The sheet of paper 9 from which the cartridge is to be made is pressed against the drum 1 by a roller 8 and this sheet 9 is thus driven against the concave surface of a curved guide 10, of which the end $10_1$ carries the sheet of paper close to the two guides 11 and 12 which together define a circular cross-section, the diameter of which is slightly greater than the diameter of the face value of the voins in the stack to be cartridge packaged.

The guides 11 and 12 made from flexible material and particularly of foil-like material are fixed respectively at the end of arms 13 and $14_1$ pivoting at $13_1$ and $14_2$.

Thus, when the roller 8 applies the sheet of paper 9 onto the drum 1, the sheet 9 follows the concave curvature of the curved guide 10 then, when it arrives close to the end $10_1$ it is diverted towards the guides 11 and 12 to form a paper tube of circular cross-section.

When this partial winding of the sheet of paper is carried out, the stack of coins is then deposited in the tube thus formed.

The tube is then made up in that the tube and the coins which it contains are pushed within the corridor 4 by the action of the guide 11. Upon this pushing of the tube of coins, the latter is caused to rotate by rolling on the curved surface 2, the effect of which is to produce a gripped rolling of the sheet of paper on the stack of coins, this tube being finally pinched between the pair of rollers 6 and 7 and the drum 1 which continues to entrain the tube of coins $9_1$ so that it performs a rotary movement. The tube of coins will then itself trigger the operation of crimping of the tube and to this end it imparts a rotary movement to the roller 7. This roller 7 is rigid with a pinion 31 which meshes with a pinion 32 mounted on a spindle 33 on which are likewise fixed two circular cams 34 and two bell cams 35.

The circular cams 34 are provided with a notch $34_1$ in which it is possible for rollers 36 carried by a fixed spindle $36_1$ to become seated. The bell cams 35 are provided at their facing end with a sawtooth ramp of which one of the oblique flanks $37_1$ is used during the crimping operation, while the stiffer flank $37_2$ is used during the operation of withdrawal from the crimping mechanism when crimping of the cartridge is finished and the cartridge has to be ejected.

The arms $27_1$, $28_1$ supporting the crimping rollers $27_2$ and $28_2$ are provided with rollers 38 and are fixed on rings 39 mounted to slide on the spindle 33. Springs (not shown) are mounted about the spindle 33 and bear on these rings 39 in order to maintain the roller 38 against the flanks $37_3$, $37_2$ of the bell cams 35.

Furthermore, the notches $34_1$ in the circular cams 34 are positioned on the spindle 33 so that the notches $34_1$ are seated around rollers 36 to allow withdrawal of the spindle 33 and of the crimping mechanism when the rollers 38 start to bear on the stiffer flank $37_2$ of the bell cams.

This crimping device operates as follows.

When the spindle 33 is caused to rotate by the drum 1 through the tube $9_1$ of coins in the roll 7 and pinions 31, 32, rotation of the bell cams 35 has the effect of bringing together the crimping rollers $27_2$ and $28_2$ simultaneously with rotation of the tube of coins under the action of the drum 1. The crimping operation is continued then until the notches $34_1$ are positioned opposite the rollers 36, the effect of which is to allow a slight withdrawal of the assembly consisting of the spindle 33 and all the parts which it supports and in particular the tube 7 which is pivotally connected to the spindle 33 through arms 24.

This withdrawal results from the pressure exerted by the roller 6 and rotation of the drum 1. Indeed, the pressure of the roller 6 is transmitted to the spindle 33 through the roll of coins $9_2$, the drum 7 and the arms 24.

At this stage, and as soon as the notches $34_1$ are housed over the rollers 36, the roller 7 is immobilized in its rotary movement in view of the fact that the rollers 36 immobilise the rotation of the spindle 33 and the pinions 32 and 31 through circular cams 34. The immobilized drum 7 then constitutes a rotationally rigid surface on which rolls the cartridge of coins $9_2$ which is still driven with a rotary motion by the drum 1. The cartridge $9_2$ is then displaced in the direction of the arrow F (FIG. 19) and is ejected while the concomitant withdrawal of the roller 7 produces an additional withdrawl of the spindle 33 in order to push the notches $34_1$ more deeply over the rollers 36.

Figure 3:
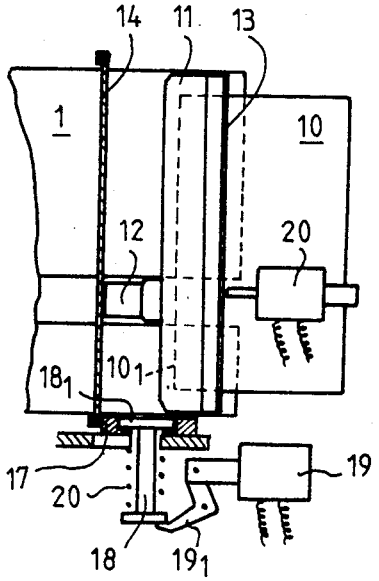
FIG. 3 is a section taken on the line B—B in FIG. 1.

After ejection of the catridge $9_2$, the spindle 33 and the roller 7 come back to the initial position under the action of restoring springs, not shown, and the notches $34_1$ of the circular cams 34 become detached from the rollers 36. The spindle 33 is then free to rotate and the rollers 38 which constantly seek to move away from each other under the action of springs acting on the rings 39 producing a slight rotation of the ball cams 35 and therefore of the circular cams 34 so that these notches $34_1$ are offset from the rollers 36, the periphery of the circular cams 34 bearing on the rollers 36 as shown in FIG. 3.

The whole of the mechanism has then returned to the initial position in order to recommence a crimping operation (FIGS. 16 and 17) when a paper tube $9_1$ containing a stack of coins arrives between the rollers 6 and 7 and the drum 1.

In the example shown in FIGS. 2 to 5, the spindle $36_1$ supporting the rollers 34 is fixed while the spindle 33 and all the parts which it supports are adapted for movement against restoring springs. Another embodiment may, however, be invisaged where the spindle 33 is fixed in position while the spindle $36_1$ is adapted for movement against restoring springs. In this case, however, the drum 37 carried by the pivoting arms 24 will always be subject to the action of restoring springs so as suitably to grip the tube of coins $9_1$ during the crimping operation.

I claim:

1. A method of putting stacks of coins into tubes, comprising the steps of:

partially rolling up a sheet of paper to form at least one complete circumference of a tube of which the circular cross-section is slightly greater than the diameter of the coins to be packaged, placing a stack of coins inside the tube, moving the stack of coins and the tube towards one of the ends of a corridor, said corridor being defined by two surfaces having parallel generatrices, one of said surfaces being adapted for movement in the direction of displacement of the stack and of the tube so that it displaces the tube and the stack of coins along the corridor by rolling on the non-moving surface, and continuing to roll up the sheet of paper around the stack of coins.

2. A method according to claim 1, wherein the stack of coins and the tube are displaced towards one of the ends of the corridor at a speed such that the speed of the generatrix of the tube which comes in contact with a drum is greater than the peripheral speed of the drum.

3. A method according to claim, 1 further comprising the step of crimping the ends of the paper tube on the stack of coins at the said one end of the corridor while the tube is kept immobile in position but capable of rotary movement on itself by maintenance of its contact with the movable surface.

4. An installation for putting stacks of coins into cartridges, comprising:

a drum, said drum having a periphery, a surface disposed opposite said periphery of said drum and being parallel with the periphery of said drum;

a corridor defined between said drum and said surface, a pivoting means to which said surface is attached, a first guide, of generally circular form being disposed at the upstream end of and across said corridor in respect of the direction of rotation of said drum and to which said surface is pivotably attached for forming a tube by winding at least one complete circumference of a paper tube, means for feeding a sheet of paper to said guide, means for placing a stack of coins into said tube while said tube is stationary at said guide, means for moving said guide out of said corridor, and means for rotating said drum to roll said tube and stack along said surface to roll up the sheet of paper around the stack.

5. An installation according to claim 4, further comprising an elastic means, said means acting to push said surface in the direction of said periphery of said drum.

6. An installation according to claim 4, wherein said corridor has an upstream end and a downstream end.

7. An installation according to claim 4, wherein said pivoting means comprises a first spindle, said first spindle being parallel with the axis of said drum and is situated in the vicinity of said upstream end of said corridor.

8. An installation according to claim 4, comprising a second guide, said guides being disposed on the upstream end of said corridor wherein said second guide is adapted for movement in the direction of the corridor under the action of an electromagnetic means in order to produce translatory movement of a tube of coins towards the corridor and wherein said first guide is disposed diametrically opposite said second guide and is adapted for pivoting movement under the action of the thrust exerted during translatory movement of the tube of coins.

9. An installation according to claim 8, further comprising moving means which allows said first guide to move aside from the corridor while the tube of coins is rolling within the corridor.

10. An installation according to claim 9 wherein said moving means comprises a notch.

11. An installation according to claim 4, further comprising: a first roller, and a third guide, wherein a supply of paper to said first and second guides is achieved by entrainment of the sheet of paper by said drum which is caused to perform a continuous rotation and against which the sheet is applied by said first roller, said third guide being provided between said first roller and said first and second guides to form a paper tube which is spaced apart from said periphery of said drum.

12. An installation according to claim 4 further comprising a guide blade and wherein said drum comprises an annular groove in which said guide blade is partially disposed so that it is parallel with the axis of said drum and inclined in relation to said periphery of said drum, said guide blade being disposed at the height of said first and second guides in order to move the sheet of paper away from said drum and guide it towards said first and second guides.

13. An installation according to claim 4 further comprising:

a bearing surface located at the base of said first and second guides, said surface having a movable rod, a control means which propels said movable rod between two positions in which the end of said rod is situated either in the plane of said bearing surface or above said bearing surface, and an operating means which is actuated when coins drop into the paper tube, said operating means placing said rod above said bearing surface only when a few coins have become stacked in the paper tube.

14. An installation according to claim 13, further comprising a restoring spring, wherein said movable rod is adapted for movement under the action of said operating means and against said restoring spring.

15. An installation according to claim 4 further comprising a second roller and a third roller wherein the entrainment of the paper tube containing the coins so that it rotates on itself during the crimping operation is performed by said drum againt which the tube is applied by said second and third rollers mounted for free rotation, and wherein said second roller is supported at the downstream end of said corridor by said surface.

16. An installation according to claim 15, further comprising a screwthreaded rod, a pair of nuts and a means for crimping the end of the paper tube onto the stack of coins and wherein said second roller imparts rotary movement to said screwthreaded rod via said drum and the paper tube containing the coins, said screwthreaded rod being parallel with the axis of said drum, and having two screwthreaded zones of opposite pitch, each of said zones co-operating with one of said nuts which is rotationally rigid.

17. An installation according to claim 16, further comprising a pair of abutments and wherein said nuts consist of half-nuts.

18. An installation according to claim 17, wherein said abutments are adapted for movement in the direction of said screwthreaded rod and push the half-nuts against the screwthreaded zones of opposite pitch.

19. An installation according to claim 18, wherein said abutments are capable of having their positions adjusted parallel with the rod according to the face value of the coins in the paper tube.

20. An installation according to claim 8, wherein said second guide consists of a first flexible blade having a free end which is positioned close to said drum, a rod connected to said free end and which is operated by an operating means, said first flexible blade being of a length which can be regulated according to the face value of the coins in the paper tube, while said first guide can be positionally adjusted according to the face value of the coins in the paper tube.

21. An installation according to claim 20, wherein the length of said first guide, the position of the first guide and the position of the pivoting axis of said corridor can be regulated by a common control according to the face value of the coins in the paper tube.

22. An installation according to claim 16, further comprising: two bell cams, a fourth roller and a second spindle parallel with said fourth roller, wherein said bell cams face each other on said second spindle and wherein a crimping means is driven by said fourth roller and through the intermediary of said bell cams.

23. An installation according to claim 22, further comprising a circular cam, a fifth roller and a tube, wherein said second spindle supporting said bell cams is rigid and wherein said circular cam has a notch co-operating with said fifth roller, said fifth roller and said circular cam being adapted for relative movement to cause ejection of the tube when the crimping means moves away.

24. An installation according to claim 23, wherein said bell cams comprises a sawtooth ramp having a pair of flanks, and wherein the least stiff oblique flank of said ramp co-operates with the crimping means to crimp a tube and the stiffer flank of said ramp co-operates with the crimping means as its moves away upon completion of crimping when said fifth roller comes to be housed in the notch in the circular cam.

* * * * *